US006805786B2

(12) United States Patent
Tran et al.

(10) Patent No.: US 6,805,786 B2
(45) Date of Patent: Oct. 19, 2004

(54) PRECIOUS ALLOYED METAL SOLDER PLATING PROCESS

(75) Inventors: Dean Tran, Westminster, CA (US); Salim Akbany, Diamond Bar, CA (US); Ronald A. DePace, Mission Viejo, CA (US); William L. Jones, Inglewood, CA (US); Roosevelt Johnson, Compton, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/253,058

(22) Filed: Sep. 24, 2002

(65) Prior Publication Data

US 2004/0055889 A1 Mar. 25, 2004

(51) Int. Cl.[7] ..... C25D 5/00

(52) U.S. Cl. ..... 205/91; 205/101; 205/102; 205/104; 205/238; 205/247; 205/251

(58) Field of Search ..... 205/91, 101, 102, 205/104, 238, 247, 251

(56) References Cited

U.S. PATENT DOCUMENTS

| | | | | |
|---|---|---|---|---|
| 4,251,327 | A | * 2/1981 | Grenon | 205/86 |
| 4,411,965 | A | 10/1983 | Rosegren et al. | |
| 4,661,213 | A | 4/1987 | Dorsett et al. | |
| 4,962,000 | A | * 10/1990 | Emslander et al. | 428/461 |
| 5,234,865 | A | 8/1993 | Goebel et al. | |
| 5,427,865 | A | 6/1995 | Mullen, III et al. | |
| 5,591,480 | A | * 1/1997 | Weisman et al. | 216/13 |
| 5,798,395 | A | * 8/1998 | Lauf et al. | 522/1 |
| 5,933,758 | A | 8/1999 | Jain | |
| 6,030,877 | A | 2/2000 | Lee et al. | |
| 6,294,725 | B1 | 9/2001 | Hirschberg et al. | |
| 6,323,128 | B1 | 11/2001 | Sambucetti et al. | |
| 6,379,520 | B1 | 4/2002 | Kuriyama et al. | |
| 6,383,843 | B1 | 5/2002 | Foong et al. | |
| 6,404,566 | B1 | 6/2002 | Andersen et al. | |
| 6,406,610 | B1 | 6/2002 | Lowe | |
| 6,417,573 | B1 | 7/2002 | Pendse | |
| 2001/0040047 | A1 | 11/2001 | Konrad et al. | |
| 2002/0070126 | A1 | 6/2002 | Sato et al. | |
| 2002/0084311 | A1 | 7/2002 | Barth | |

OTHER PUBLICATIONS

Pat F. Metone, "Rectifying Electronics Finishing, What You Need to Know", http://dynatronix.com/need.html.
Norman M. Osero, "An Overview of Pulse Plating", http://dynatronix.com/overview.html.
D–T. Chin et al., "Selective Pulse Plating of Gold and Tin–Lead Solder", http://dynatronix.com/goldtin.html.
Chuck Van Horn, "Pulse Plating", http://dynatronix.com/chuck.html.

(List continued on next page.)

*Primary Examiner*—Robert R. Koehler
(74) *Attorney, Agent, or Firm*—Katten Muchin Zavis Rosenman; John S. Paniaguas

(57) ABSTRACT

A relatively simple and inexpensive process for plating precious alloyed metals, such as AuSn, AuSnIn, AgSn, AuIn and AgIn. Anodes are formed from each of the metal components in the alloy and disposed in a conducting solution. The mass of each metal components is determined by Faraday's law. The target is also disposed in the conducting solution. Plating current is independently applied to each anode. The plating is conducted under an ultraviolet light sources to optimize the process. The plating alloys can be used for various purposes including attaching a semiconductor die to a substrate. Since the process does not involve exposure of the semiconductor die to a relatively high temperature for a relatively long time, the process does not pose a risk of contamination of the semiconductor by the adhesive or wax used to hold the die in place on the carrier during processing. Moreover, unlike earlier known processes which utilize epoxy, the precious alloyed metals do not wet the entire die but only the metal contact areas, thus avoiding potential short circuit to the die.

22 Claims, 5 Drawing Sheets

OTHER PUBLICATIONS

P. Leisner et al. "Throwing Power in Pulse Reverse Plating from an Acid Copper Bath", http://dynatronix.com/copper.html.

Enrique Gutierrez, "Pulse Reverse Electroplating Returns to Basics".

Williams Advanced Materials, "Packaging Materials—Solder Alloys", http://williams–adv.com/solderalloys.php.

Williams Advanced Materials, "About Williams—Technical Info", http://www.williams–adv.com/technicalinfo.php?action=view&articleid=39.

Stellar Industries, homepage, http://www.stellarind.com/5metiz.html.

Ultrasource, Inc., "Custom Manufacturing of Thin Film Circuit Devices", http://ultra–source.com.

Steller Industries, "Laser Diode Subamounts with Predeposited Gold/Tin (AuSn)".

"Solder–Friendly, Voted Best Electrical Performance Gold–Coated Contacts", *Techbits*, vol. 1, Issue 1, Sep. 2001.

* cited by examiner

Untitled:2

Label:identify bright material 150x 15kv area 1 kV:15.0 Tilt:0.0 Take-off:11.2 Det Type:SUTW+ Res:134 Tc:40

FS : 2984 Lsec : 56 28-Jul- 0 10:55:57

EDAX ZAF Quantification (Standardless)
Element Normalized

| Element | Wt% | AT% | K-Ratio | Z | A | F |
|---|---|---|---|---|---|---|
| SnL | 19.08 | 28.13 | 0.0995 | 1.0580 | 0.4928 | 1.0000 |
| AuL | 80.92 | 71.87 | 0.7838 | 0.9698 | 0.9989 | 1.0000 |
| Total | 100.00 | 100.00 | | | | |

| Element | Net Inte. | Bkgd Inte. | Inte. Error | P/B |
|---|---|---|---|---|
| AuM | 355.00 | 23.61 | 0.73 | 15.04 |
| SnL | 36.43 | 18.17 | 2.69 | 2.00 |
| AuL | 13.98 | 5.60 | 4.20 | 2.50 |

X-ray analysis at top of plated sample.

EDAX ZAF Quantification (Standardless)
Element Normalized

| Element | Wt% | AT% | K-Ratio | Z | A | F |
|---|---|---|---|---|---|---|
| SnL | 19.50 | 28.68 | 0.1020 | 1.0577 | 0.4943 | 1.0000 |
| AuL | 80.50 | 71.32 | 0.7792 | 0.9691 | 0.9989 | 1.0000 |
| Total | 100.00 | 100.00 | | | | |

| Element | Net Inte. | Bkgd Inte. | Inte. Error | P/B |
|---|---|---|---|---|
| AuM | 282.00 | 17.46 | 0.79 | 16.15 |
| SnL | 30.41 | 17.69 | 2.93 | 1.72 |
| AuL | 11.32 | 5.64 | 4.67 | 2.01 |

X-ray analysis at center of plated sample.

Untitled:2

Label:identify bright material 150x 15kv area 2 kV:15.0 Tilt:0.0 Take-off:11.2 Det Type:SUTW+ Res:134 Tc:40

FS : 2811 Lsec : 54 28-Jul- 0 10:59:54

EDAX ZAF Quantification (Standardless)
Element Normalized

| Element | Wt% | AT% | K-Ratio | Z | A | F |
|---|---|---|---|---|---|---|
| SnL | 17.39 | 25.88 | 0.0896 | 1.0594 | 0.4865 | 1.0000 |
| AuL | 82.61 | 74.12 | 0.8025 | 0.9724 | 0.9990 | 1.0000 |
| Total | 100.00 | 100.00 | | | | |

| Element | Net Inte. | Bkgd Inte. | Inte. Error | P/B |
|---|---|---|---|---|
| AuM | 435.17 | 21.89 | 0.67 | 19.88 |
| SnL | 37.85 | 17.72 | 2.67 | 2.14 |
| AuL | 16.51 | 6.29 | 3.92 | 2.62 |

X-ray analysis at bottom of sample.

PRECIOUS ALLOYED METAL SOLDER PLATING PROCESS

BACKGROUND OF THE INVENTION

1. Field of the Invention

The present invention relates to a semiconductor process and more particularly to a process for plating precious alloyed metals, such as AuSn, AuSnIn, AgSn, AuIn and AgIn, for use, for example, for attaching a semiconductor die to a substrate or housing in high reliability applications.

2. Description of the Prior Art

Conventional integrated circuits include a semiconductor die cut from a semiconductor wafer to a standard chip size. The semiconductor die is normally attached to a substrate or housing by way of an adhesive, such as an epoxy or solder. The adhesive is known to be cured at relatively high temperatures, such as 150° C. to 160° C. Unfortunately, such a technique is known to produce air pockets between the semiconductor die and the substrate that can cause a void therebetween.

There are other risks associated with the use of epoxy for attaching a semiconductor die to a substrate. For example, since epoxy can wet virtually any material, in some situations, the epoxy has been known to wet from the edge of the semiconductor die to the top causing a short circuit.

In order to avoid these problems in relatively high reliability applications, such as military and space applications, the semiconductor die is known to be attached to the substrate with precious alloyed metals, such as gold-tin (AuSn), silver-tin (AgSn), gold-indium (AuIn) and silver-indium (AgIn). However, because of the largely differential melting point of the metal components in the alloys, such alloys are not suitable for evaporation and heavily waste the alloyed metal during sputtering processes in order to obtain a thickness of the solder alloys from 5 $\mu$m to 25 $\mu$m.

As such, precious alloyed metal solder techniques are known to have been developed. These techniques are known to be rather complicated and expensive. For example, in one known process, precious alloyed metal preforms are used. Such precious metal alloyed preforms are known to be produced by a rather complicated metallurgical process and are thus expensive. An example of such a precious alloyed metal preform is disclosed in U.S. Pat. No. 5,427,865, hereby incorporated by reference. As disclosed in U.S. Pat. No. 5,234,865, solder preforms, such as precious alloyed metal solder preforms, are disposed between two components to be soldered, such as a semiconductor die and a substrate. The assembly is heated to a temperature greater than the melting point of the precious metal alloy, which causes the solder to reflow and, upon cooling, attaches the wetable surfaces of the semiconductor die to the substrate.

Because of cost of producing precious alloyed metal solder preforms, other techniques have been developed. For example, gold-tin alloyed solder is known to be formed by depositing layers of gold/tin/gold onto a substrate by vacuum deposition. These layers are then alloyed together at a relatively high temperature, for example, 220° C., for at least three (3) hours to allow the gold and tin layers to inter-diffuse and form a gold-tin alloy. Although such a process is effective for forming a gold-tin alloy, the process is extremely expensive and requires a relatively large capital equipment investment as well as involves a relatively high labor cost. Moreover, the semiconductor dies are known to be temporarily attached to the substrates by way of wax or a thermal film. Due to the exposure to relatively high temperatures for a relatively long period of time, such a process may result in contamination of the semiconductor die from the wax. Accordingly, there is a need for a process for attaching a semiconductor die to a substrate with a precious alloyed metal that is relatively simpler and less expensive than known processes and does not pose a contamination or short circuit risk to the semiconductor die.

SUMMARY OF THE INVENTION

The present invention relates to a relatively simple and inexpensive process for plating precious alloyed solder, such as AuSn, AuSnIn, AgSn, AuIn and AgIn. Anodes are formed from pure metals in the alloy composition and disposed in a conducting solution. The target is also disposed in the conducting solution. The mass of the individual metal component in the alloyed solder that is transferred from the anodes is determined by Faraday's law. Plating current is independently applied to each anode. The plating is conducted under an ultraviolet light sources to optimize the process. The plating process can be used to produce different alloyed solder compositions for various applications including attaching a semiconductor die to a substrate. Since the process does not involve exposure of the semiconductor die to a relatively high temperature for a relatively long time, the process does not pose a risk of contamination of the semiconductor devices by the adhesive or wax used to hold the die in place on the substrate during processing. Moreover, unlike earlier known processes which utilize epoxy, the precious alloyed solder do not wet the entire die but only the metal contact areas, thus avoiding potential short circuit to the die.

DESCRIPTION OF THE DRAWING

These and other advantages of the present invention are readily understood with reference to the following specification and attached drawing wherein.

DETAILED DESCRIPTION

The present invention relates to a semiconductor plating process for plating various precious alloyed solders, such as AuSn, AuSnIn, AgSn, AuIn and AgIn, for use in, for example, in attaching a semiconductor die to a substrate in high reliability applications. The plating process in accordance with the present invention is relatively simple and inexpensive and avoids the use of precious alloyed metal solder performs. Moreover, the risk of contamination from an adhesive, such as a wax, used to hold the die in place on the substrate is minimized. Since the plating process in accordance with the present invention, only wets metal contacts on the semiconductor die, the risk of a short circuit from the attachment medium is virtually eliminated. The process in accordance with the present invention is particularly suitable for high reliability applications for use in military and space, which enable such semiconductors to be uniformly processed on an automated electronic assembly line.

The present invention relates to an electroplating technique for plating precious alloyed metals, such as gold-tin (AuSn), silver-tin (AgSn), gold-indium (AuIn), silver-indium (AgIn) which may be used, for example, to secure a semiconductor die, processed by various processing methods and cut from a semiconductor wafer, to a substrate. The electroplating process in accordance with the present invention is the first known electroplating process for such precious alloyed metals.

Figure 1:
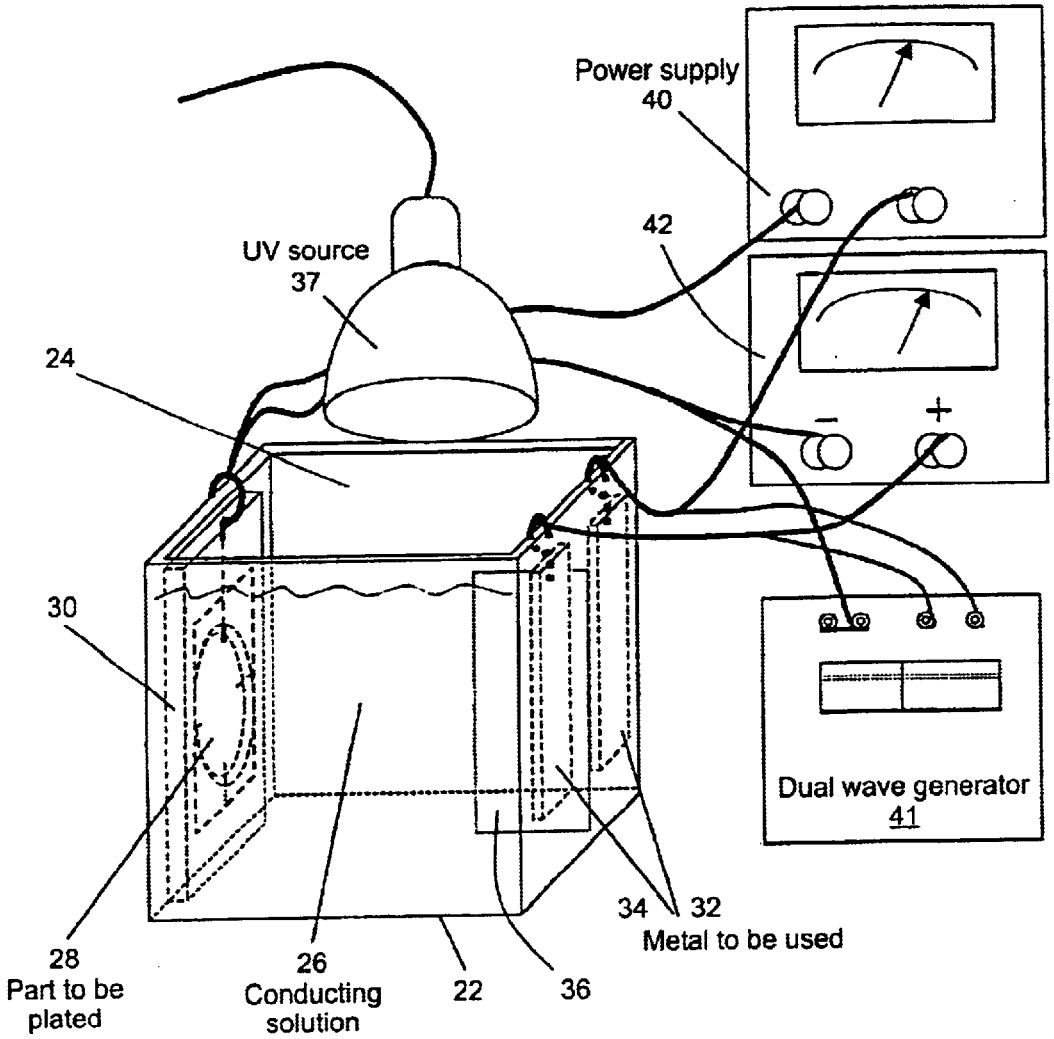
FIG. 1 is a simplified schematic diagram of a precious alloyed solder plating set-up in accordance with the present invention.

A simplified diagram for performing the electroplating process in accordance with the present invention is illustrated in FIG. 1 and generally identified with the reference numeral 20. As shown in FIG. 1, the electroplating process in accordance with the present invention is illustrated and described in terms of a complex wave type of electroplating process, however, the principles of the present invention are also suitable for use with other types of electroplating systems, such as DC, pulse, and microwave. DC electroplating systems are well known in the literature. Examples of pulse plating systems are disclosed in "Selective Pulse Plating of Gold-Tin-Lead Solder" by Chin et al., http:dynatronix.comgoldtin.html, copyright 1998; "Pulse Plating" by Vanhorn, http:dynatronix.comchuch.html, copyright 1998 and "An Overview of Pulse Plating" by Osero, http:dynatronix.comoverview.html, copyright 1998.

Referring to FIG. 1, the precious alloyed metal plating process in accordance with the present invention requires a tank 22 with an open top 24. The tank 22 is used for carrying a conducting solution 26, for example, an organic conducting salt solution. The conducting solutions is selected so that it does not react with either metal components and may be an organic conducting salt solution, for example, potassium oxalate ($K_2C_2O_4$). The organic conducting salt solution 26 is used as an atomic transferring medium for transferring the metal ions to a target 28 (i.e. part to be plated). As shown, the target 28 is carried by a carrier 30, formed from an electrically conducting material, such as platinum, and disposed against one wall of the tank 22. A pair of anodes 32 and 34 are disposed on an opposing wall of the tank 22.

Each anode 32, 34, is formed from one of the metals in the desired precious alloyed metal. For example, a gold-tin precious alloyed metal is shown. Thus, the anode 32 is formed from gold and the anode 34 is formed from tin. If, for example, a silver-tin (AgSn), the anode 32 would be formed from silver (Ag) while the anode 34 would be formed from tin (Sn). The anodes 32 and 34 are disposed within the tank 22 along a side wall opposite the side wall opposite the target 28. A pre-isolation wall 36 is used to separate the anodes 32 and 34 to prevent the anodes 32 and 34 from accidentally contacting each other and to minimize the early current leakage from one anode to the other anode.

In accordance with an important aspect of the invention, an ultraviolet light source 37, for example, a fluorescent light with a spectrum form 0.2 micron to 0.4 micron wavelengths, is illuminated, adjacent the open end 24 of the tank 22. In particular, the ultraviolet light source 37 activates a liberal electron in the plating solution and keeps this electron at a high energy level to avoid interaction of this electron with metal cations extracted from the anodes 32 and 34 and to prevent precipitation of any of the metals prior to reaching the target 28.

Each of the anodes 32 and 34 is electrically coupled to a power supply 40 by way of a potentiometer or composition controller 42. The composition controller 42 enables the magnitude of the plating current to be varied. A positive DC voltage terminal on the power supply 40 is electrically coupled to each of the anodes 32 and 34 by way of the composition controller 42. A negative DC voltage terminal from the power supply 40 is applied to the carrier 30.

Figure 5:
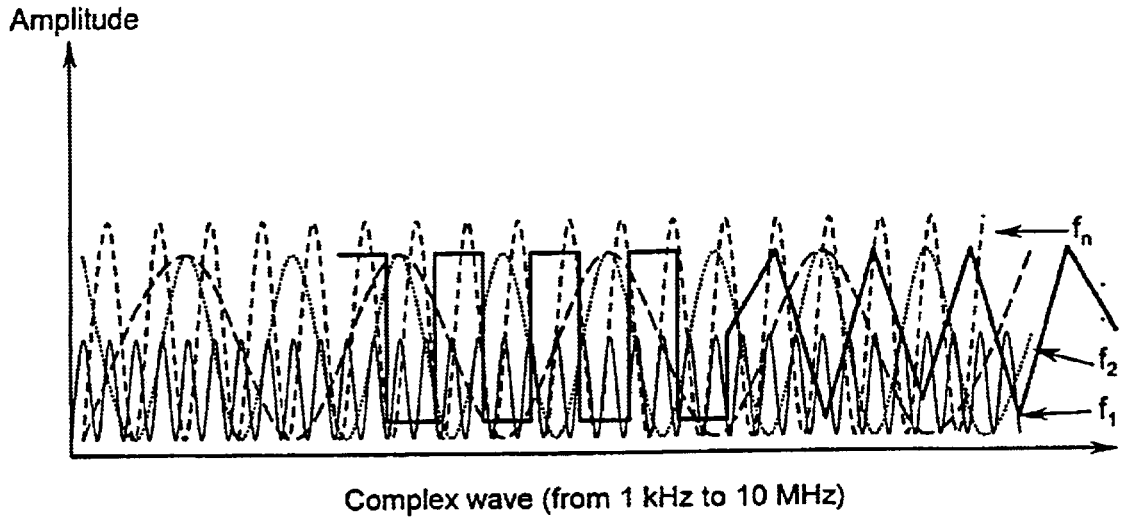
FIG. 5 is a diagram of a complex wave for use with the present invention.

As mentioned above, a complex wave may be used to increase throw power of the plating solution, which, in turn, increases the alloyed composition and thickness uniformity. Accordingly, a wave generator 41 for generating a complex wave as illustrated in FIG. 5.

The thickness of the precious alloyed solder depends on the current density applied to the anodes 32 and 34 and plating time. Faraday's law is used to calculate the weight of each plating metal. More particularly, the weight of the precious metal is calculated according to Faraday's law as illustrated in Equation 1 below:

$$m(g)=(a/e)\ WQ/v, \text{ where m is the mass of metal deposit (plate requirement);} \quad (1)$$

a=the mass of atom having an atomic weight (g); e=the charge of an electron; a/e=1f, where f=Faraday's constant=96485 coulombs/per mole;

v=valance atom deposition or liberated; W=the atomic weight of a metal that needs to be deposited; Q=IT=the quantity electricity that passes through the cell.

For a gold-tin precious alloyed metal, Au/Sn:

Au: W=197; v=3; Sn: W=119; n=4

$$m_{Au}/m_{Sn}=(v_{Sn}/v_{Au}).(W_{Au}/W_{Sn}).(I_{Au}/I_{Sn})=4/3.(197/119)(I_{Au}I_{Sn})$$

For gold-tin AuSn alloy (80/20% by weight)

$$80/20=4=2.207(I_{Au}/I_{Sn}),$$

$$I_{Au}=1.8124\ I_{Sn}=\text{plating current ration.}$$

The ratio of plating currents provided above is also dependent on other factors such as, the dose of ultraviolet atomic transfer activation energy, the size/distance of the electrodes/plating target, the method of plating, such as DC pulse and complex wave. These factors control the throw power of the plating process of each metal component in the alloy. As is will be understood by those of ordinary skill in the art, the current ratio may need to be adjusted to maintain the alloy composition ratio.

In one application of the invention, a DC power supply was used without the presence of UV, complex-wave or agitation sources. A 2"×2" metallized (Ni/Au) ceramic substrate was used as a target (cathode) and placed in a conducting solution (plating solution). The plating solution was a mixture of 20% potassium oxalate, 2% potassium chloride and 78% de-ionized (DI) water (the percentages are by weight). Two pieces of pure metal, one inch square gold and one inch square tin were used as anodes. These anodes were placed into the plating solution three inches from the cathode and with a one inch separation from each other. Between the two anodes, a pre-isolation wall was inserted. This wall was formed from high-density polymer foam. The inserted wall helps to prevent the two anodes from accidentally contacting each and minimizes current pre-leakage from one anode to the other (high setting current to low setting current). The total plating current density was 3 Amp/square inch and distributed between two anodes with the ratio 1.8 as calculated (using Faraday law). The tin anode was not oxidized in the presence of a Chloride anion, $Cl^-$, from potassium chloride (an anti-oxidant) and prevented stopping the plating process. (Without the presence of chloride, the tin anode would be oxidized, then tin cation (Sn++++) would not produce the tin and plating process would be stopped.).

Figure 2:
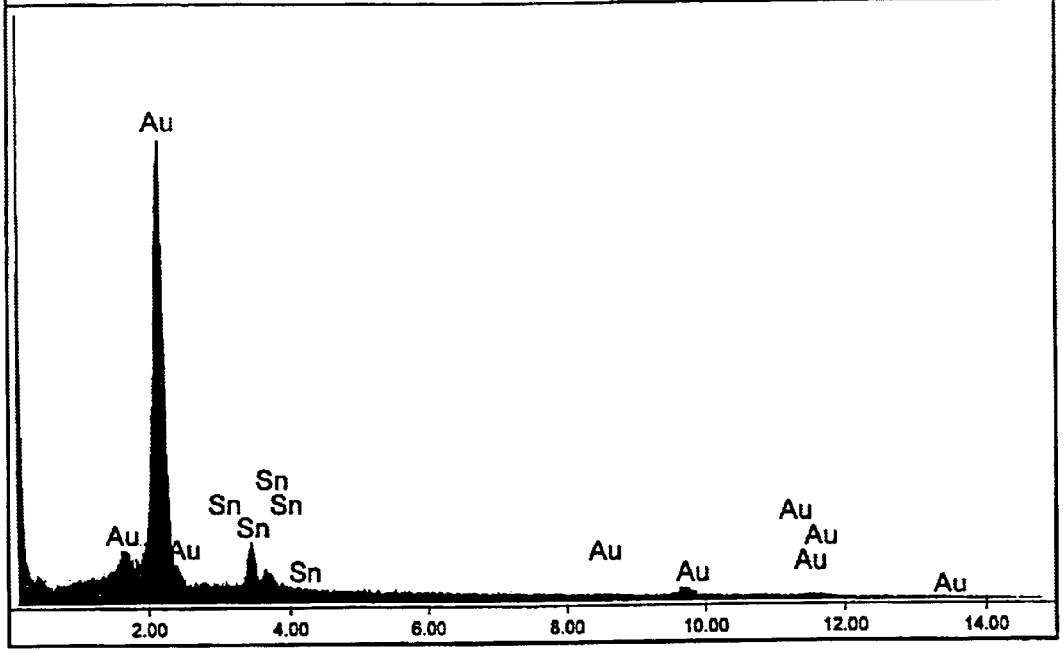
FIG. 2 is an energy dispersion X-ray (EDX) analysis of the top portion of an exemplary sample.
Figure 3:
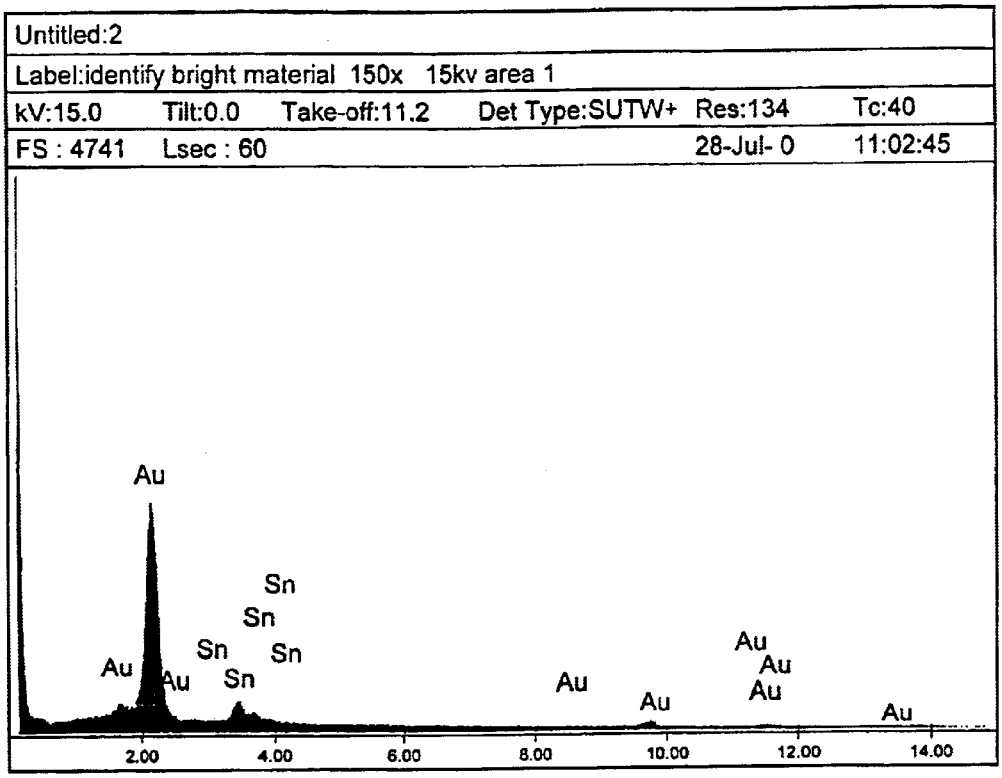
FIG. 3 is an EDX analysis of the center portion of the exemplary sample in FIG. 2.
Figure 4:
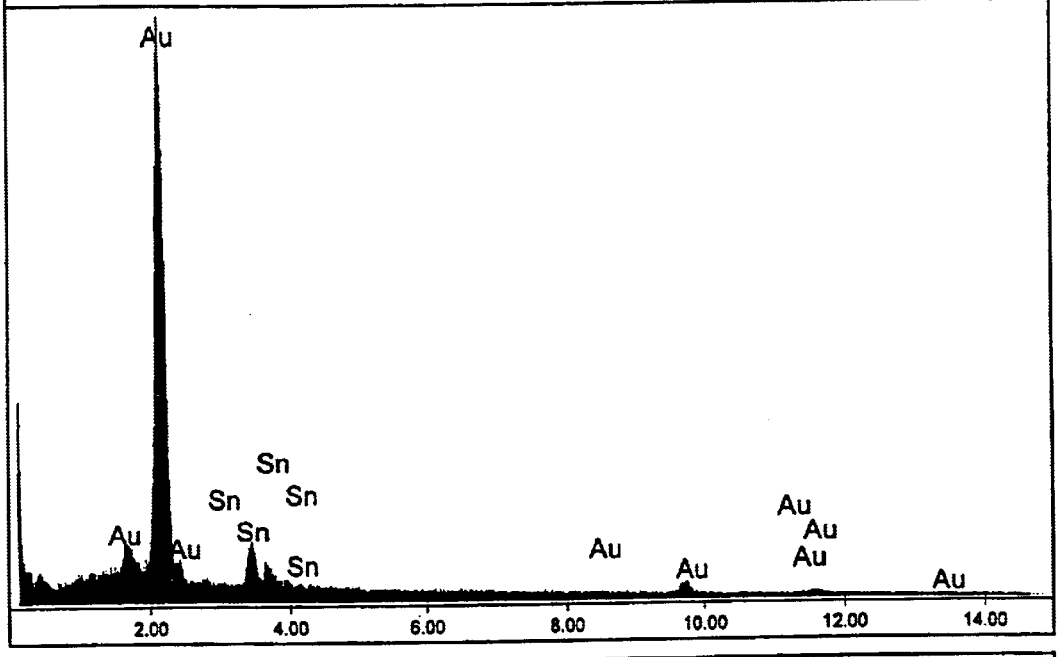
FIG. 4 is an EDX analysis of the bottom portion of the exemplary sample in FIG. 2.

The SEM image revealed that the gold-tin alloy surface morphology is very smooth and uniform through the sample. FIGS. 2–4 represent an energy dispersion X-ray (EDX) analysis results of this sample. The purpose of this plating process was to produce a gold tin solder alloy 80% Au(gold) 20% Sn(tin). The EDX analysis shows that the gold-tin alloy produced in this experiment is well matched with the theoretical calculation.

As will be recognized in the art, fine tuning of the current ratio setting between the two anodes with the presence of complex-wave, UV light and agitation sources will increase the uniformity and control the composition (ratio of gold and tin) through the sample. This invention is not limited to the use of two anodes to produce the binary (two metal components) alloy; it also can use three, four or many anodes to produce ternary, quaternary or multiple metals alloy.

Obviously, many modifications and variations of the present invention are possible in light of the above teachings. Thus, it is to be understood that, within the scope of the appended claims, the invention may be practiced otherwise than as specifically described above.

What is claimed and desired to be covered by a Letters Patent is as follows:

1. An electroplating process for plating precious alloyed metals onto a target, the process comprising:

a) providing a tank open on one end;

b) disposing a target within said tank;

c) disposing a plurality of anodes inside tank opposite said target, each anode formed from gold or silver alloys one metal in said precious alloyed metal;

d) disposing a conducting solution in said tank;

e) disposing a target in said tank carried by an electrically conductive carrier;

f) applying a source of ultraviolet energy to said tank; and g) applying a source of electrical energy to each of said anodes and said carrier.

2. The process as recited in claim 1, wherein a source of electrical energy is applied to each of said anodes.

3. The process as recited in claim 2, wherein said source of electrical energy applied to each of said anodes is a pulse.

4. The process as recited in claim 2, wherein said source of energy applied to each of said anodes is a source of microwave energy.

5. The process as recited in claim 2, wherein said source of electrical energy applied to each of said anodes is a source of continuous DC.

6. The process as recited in claim 1, wherein conducting solution is selected so that it does not react with either anode.

7. The process as recited in claim 6, wherein said conducting solution is selected as an anti-oxidant.

8. The process as recited in claim 7, wherein said conducting solution includes potassium oxalate.

9. The process as recited in claim 7, wherein said anti-oxidant is potassium chloride.

10. A process for depositing a precious metal alloy on a target comprising the steps of:

a) disposing a target in a conductive bath; and b) electroplating a gold or silver alloyed metal on said target.

11. The process as recited in claim 10, wherein said precious alloyed metal is AuSn.

12. The process as recited in claim 10, wherein said precious alloyed metal is AuSnIn.

13. The process as recited in claim 10, wherein said precious alloyed metal is AgSn.

14. The process as recited in claim 10, wherein said precious alloyed metal is AuIn.

15. The process as recited in claim 10, wherein said precious alloyed metal is AgIn.

16. The process as recited in claim 10, wherein a separate anode is provided for each metal in said precious alloyed metal.

17. The process as recited in claim 10 wherein step (b) includes providing a source of ultraviolet energy to said conductive bath.

18. The process as recited in claim 15, wherein step (b) includes applying a source of electrical energy to said anodes.

19. The process as recited in claim 18, wherein said source of electrical energy is a continuous DC source.

20. The process as recited in claim 18, wherein said source of electrical energy is a complex wave.

21. The process as recited in claim 18, wherein said source of electrical energy is a pulsed source.

22. The process as recited in claim 18, wherein said source of electrical energy is a microwave source.

* * * * *

UNITED STATES PATENT AND TRADEMARK OFFICE

CERTIFICATE OF CORRECTION

PATENT NO. : 6,805,786 B2
DATED : October 19, 2004
INVENTOR(S) : Dean Tran et al.

It is certified that error appears in the above-identified patent and that said Letters Patent is hereby corrected as shown below:

Column 5,
Lines 34-36, should read as follows:
c) disposing a plurality of anodes inside said tank opposite said target, each anode formed from gold or silver alloys, said alloy being one metal in said precious alloyed metal;

Signed and Sealed this

Nineteenth Day of April, 2005

JON W. DUDAS
*Director of the United States Patent and Trademark Office*